US009731893B2

(12) United States Patent
Thiessen

(10) Patent No.: US 9,731,893 B2
(45) Date of Patent: Aug. 15, 2017

(54) CATALYTIC HEATING ASSEMBLY FOR AN OIL STORAGE TANK

(71) Applicant: Lester James Thiessen, Neilburg (CA)

(72) Inventor: Lester James Thiessen, Neilburg (CA)

(73) Assignee: ENVIRO PRODUCTION SYSTEMS INC., Calgary, Alberta (CA)

( * ) Notice: Subject to any disclaimer, the term of this patent is extended or adjusted under 35 U.S.C. 154(b) by 175 days.

(21) Appl. No.: 14/689,257

(22) Filed: Apr. 17, 2015

(65) Prior Publication Data

US 2015/0298900 A1 Oct. 22, 2015

Related U.S. Application Data

(60) Provisional application No. 61/980,882, filed on Apr. 17, 2014.

(51) Int. Cl.

| | |
|---|---|
| ***B65D 88/74*** | (2006.01) |
| ***F24H 1/20*** | (2006.01) |
| ***E21B 36/00*** | (2006.01) |
| ***F28F 1/32*** | (2006.01) |
| ***F23D 14/18*** | (2006.01) |
| ***F24H 9/18*** | (2006.01) |

(52) U.S. Cl.

CPC ..... *B65D 88/744* (2013.01); *B65D 88/748* (2013.01); *F24H 1/206* (2013.01); *F24H 9/1836* (2013.01)

(58) Field of Classification Search

None

See application file for complete search history.

(56) References Cited

U.S. PATENT DOCUMENTS

| | | | | | |
|---|---|---|---|---|---|
| 3,757,745 | A * | 9/1973 | Miller | F22B 7/12 | 122/136 R |
| 3,911,896 | A * | 10/1975 | Charboneau | F24H 1/0045 | 122/21 |
| 5,433,174 | A * | 7/1995 | Brady | F22B 21/26 | 110/234 |
| 5,494,025 | A * | 2/1996 | Smoker | F24H 9/1836 | 122/17.2 |
| RE35,696 | E * | 12/1997 | Mikus | E21B 36/02 | 166/303 |
| 6,065,957 | A * | 5/2000 | Kondo | F23C 9/00 | 431/116 |
| 6,394,042 | B1 * | 5/2002 | West | F24H 1/28 | 110/234 |

(Continued)

*Primary Examiner* — Gregory Huson
*Assistant Examiner* — Eric Gorman
(74) *Attorney, Agent, or Firm* — Ryan W. Dupuis; Kyle R. Satterthwaite; Ade & Company Inc.

(57) ABSTRACT

In an oil storage tank having an interior oil storage chamber and a tank opening in one of the boundary walls, a heating assembly is supported to extend into the interior oil storage chamber from the tank opening. The assembly includes a casing of walls surrounding with a casing mounting flange mountable in sealing engagement relative to a tank mounting flange about the full perimeter of the tank opening such that the casing protrudes into the interior oil storage chamber of the oil storage tank. The heating chamber is suitable sized and configured to operably receive a catalytic heater therein. The heating chamber further accommodates entry of combustion air and combustion fuel into the heating chamber and exhaust of emissions therefrom.

16 Claims, 3 Drawing Sheets

(56) References Cited

U.S. PATENT DOCUMENTS

| | | | | |
|---|---|---|---|---|
| 7,293,606 | B2 | 11/2007 | Benoit et al. | |
| 2011/0247786 | A1* | 10/2011 | Dixon | F28D 7/16 165/96 |
| 2011/0311928 | A1* | 12/2011 | Zimmer | F17C 7/04 432/9 |
| 2014/0048534 | A1* | 2/2014 | Thiessen | B65D 88/128 220/23.83 |
| 2014/0096832 | A1* | 4/2014 | Thiessen | E21B 43/34 137/1 |
| 2014/0245972 | A1* | 9/2014 | Thiessen | B65D 88/744 122/18.3 |
| 2014/0369890 | A1* | 12/2014 | Hirabayashi | C01B 3/36 422/109 |

* cited by examiner

CATALYTIC HEATING ASSEMBLY FOR AN OIL STORAGE TANK

This application claims the benefit under 35 U.S.C. 119(e) of U.S. provisional application Ser. No. 61/980,882, filed Apr. 17, 2014.

FIELD OF THE INVENTION

The present invention relates to a heating assembly arranged to be received in a storage tank, for example an oil storage tank, in which the heating assembly comprises a heating chamber received within an interior of the storage tank and which in turn receives a catalytic heating unit therein.

BACKGROUND

In oil production, it is common to locate an oil storage tank at an oil well site to produce hydrocarbons from the well directly into the oil storage tank. It is also known to provide a propane burner which directs exhaust into a burner tube extending into the oil storage tank for heating oil in the tank to maintain fluidity and/or prevent freezing of contents within the tank. Heating the oil may also assist in settling sand out of the oil to the bottom of the tank, and assists with fluidity of the oil when subsequently pumping the oil into transport tanker trucks.

U.S. Pat. No. 7,293,606 by Benoit discloses a heat exchanging apparatus including a gas fuelled flameless catalytic heater. According to one embodiment, an oil storage tank is heated by locating the catalytic heater remotely from the tank and communicating heat exchanger fluid in a loop between the catalytic heater and a heater coil in the tank. Although the heat exchanger fluid can effectively heat the contents of the oil storage tank, the heat exchanger coil in the storage tank can be difficult to maintain as it is subjected to abrasive sands and corrosive fluids within the oil storage tank. Furthermore, considerable heat may be lost in communication between the remotely located catalytic heater and the heater coil in the oil storage tank.

SUMMARY OF THE INVENTION

According to one aspect of the invention there is provided a heating assembly for use with a catalytic heater unit and an oil storage tank having boundary walls surrounding an interior oil storage chamber, a tank opening in one of the boundary walls, and a tank mounting flange surrounding the tank opening, the heating assembly comprising:

a heater casing including a plurality of casing walls which surround a heating chamber defined within the casing; and a casing mounting flange joined to the casing walls;

the casing mounting flange being mountable in sealing engagement relative to the tank mounting flange such that the casing protrudes into the interior oil storage chamber of the oil storage tank;

the casing mounting flange and the casing walls of the heater casing collectively forming a barrier arranged to fully enclose the tank opening when the casing mounting flange is mounted in sealing engagement relative to the tank mounting flange; and the heating chamber being suitable sized and configured to operably receive the catalytic heater therein.

The heater casing received within the oil storage compartment of the oil storage tank allows heat to be transferred directly from the catalytic heater unit to the casing, which in turn communicates the heat directly to the surrounding oil in the storage tank. The casing occupies a larger volume than a typical heat exchanger coil for more efficient transfer of heat to the surrounding oil in the storage tank. Furthermore, the heater casing can be much more robust in construction than a typical heat exchanger coil such that abrasive sands and corrosive fluids are much less of concern with regard to maintenance of the heater unit.

The casing mounting flange is located at one end of the casing such that the casing mounting flange is joined to the casing walls such that the casing is arranged to be fully received within the interior oil storage chamber of the oil storage tank.

Preferably a main opening is provided at one end of the casing which is suitably sized to receive the catalytic heating unit therethrough. The casing mounting flange may be located at one end of the casing such that the main opening lies in a plane of the casing mounting flange.

Preferably a door is supported on the casing so as to be operable between a closed position spanning the main opening and an open position in which the main opening is sufficiently unobstructed by the door to receive the catalytic heating unit therethrough. The door is preferably heat insulated.

There may further be provided a carriage member arranged to support the heater unit thereon and a slide assembly supporting the carriage member within the casing so as to be longitudinally slidable between a loading position in proximity to the main opening and a working position spaced inwardly into the heating chamber of the casing from the main opening relative to the loading position.

The heating chamber of the casing is preferably suitably sized to receive the catalytic heater unit therein such that the casing walls are spaced apart from the catalytic heater unit on all sides thereof.

More particularly, the heating chamber of the casing is preferably suitably sized such that the catalytic heater unit is arranged to be received therein at a location corresponding to the catalytic heater unit being fully received within the interior oil storage chamber of the oil storage tank at a location spaced inwardly from the boundary walls of the oil storage tank.

The casing preferably includes a combustion air inlet and an exhaust outlet formed in the casing so as to be arranged to communicate from the heating chamber to an exterior of the storage tank.

Preferably the combustion air inlet and the exhaust outlet are formed in a common one of the casing walls at an exterior end of the casing in which the combustion air inlet is located in proximity to a bottom end of the casing and the exhaust outlet is located in proximity to a top end of the casing. There may further me provided an exhaust collection hood in communication with the exhaust outlet which is supported within the casing so as to be arranged to receive exhaust from the heater unit received therebelow.

There may further be provided a fuel supply line arranged to communicate between an external fuel supply and the catalytic heating unit within the heating chamber of the casing in which at least a portion of the fuel supply line within the heating chamber of the casing comprises a flexible line.

According to a second aspect of the present invention there is provided an oil storage tank comprising:

boundary walls surrounding an interior oil storage chamber;

a tank opening in one of the boundary walls;

a tank mounting flange surrounding the tank opening;

a heating assembly, as described above, in which the casing mounting flange is mounted in sealing engagement relative to the tank mounting flange such that the heater casing protrudes into the interior oil storage chamber of the oil storage tank, and the casing mounting flange and the casing walls of the heater casing collectively form a barrier which fully encloses the tank opening; and a catalytic heater unit operably received within the heating chamber of the casing.

Preferably the casing mounting flange is located at one end of the casing such that the casing is fully received within the interior oil storage chamber of the oil storage tank.

Preferably the catalytic heater unit is also located within the casing so as to be fully received within the interior oil storage chamber of the oil storage tank at a location spaced inwardly from the boundary walls of the oil storage tank.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
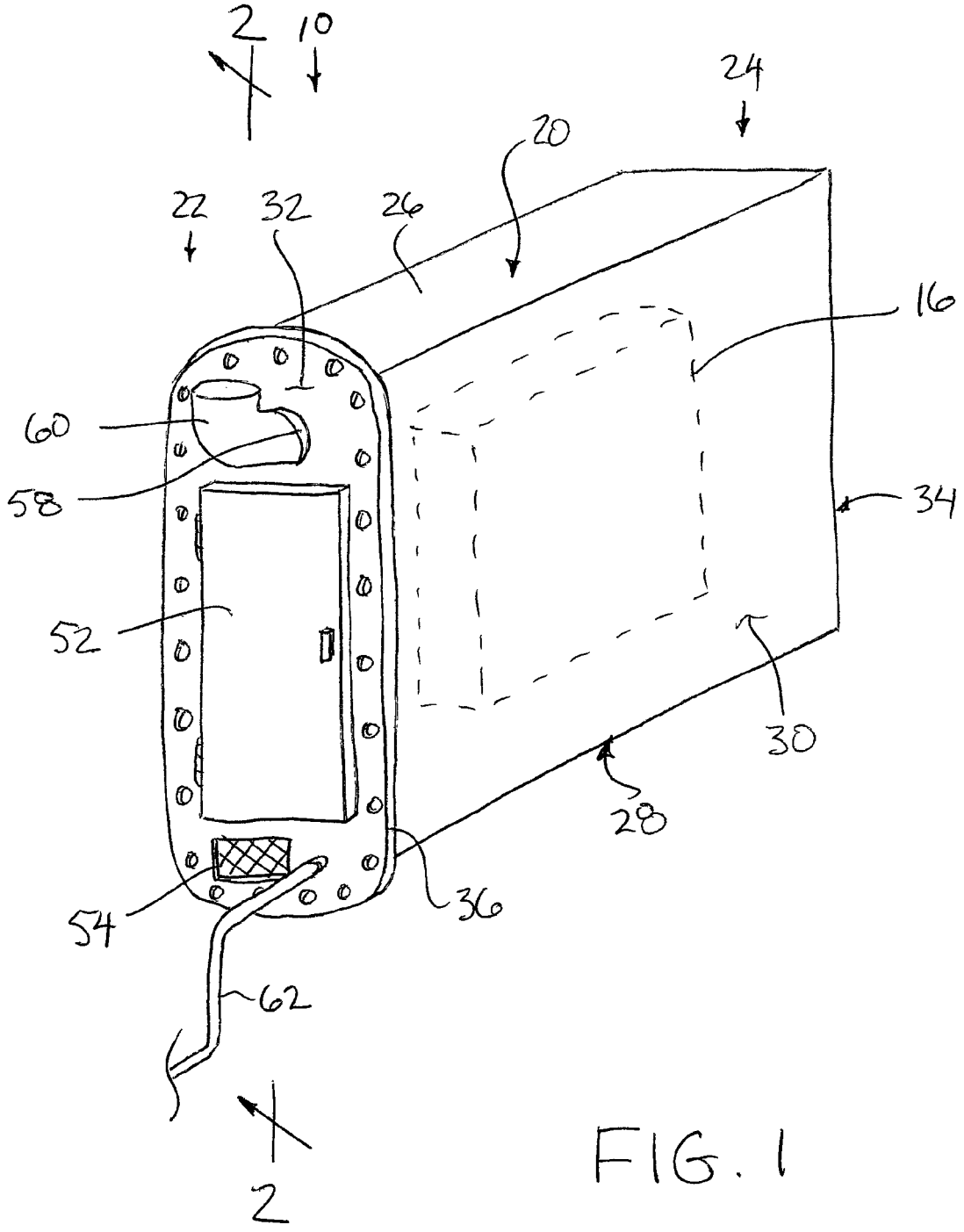
FIG. 1 is a perspective view of the heating assembly.
Figure 2:
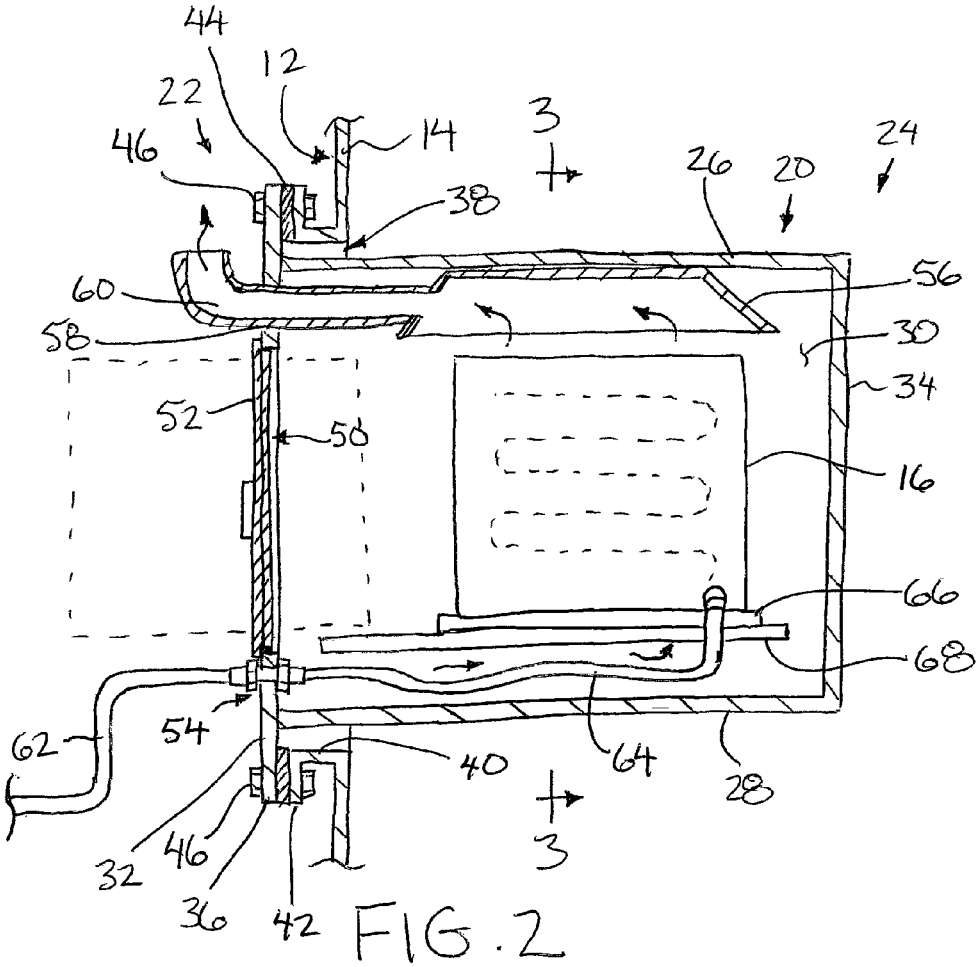
FIG. 2 is a sectional view of the heating assembly along the line 2-2 in FIG. 1.
Figure 3:
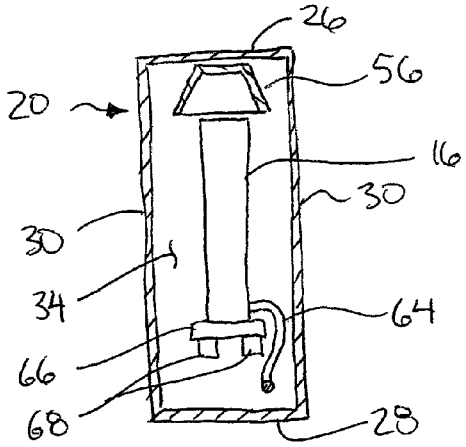
FIG. 3 is a sectional view of the heating assembly along the line 3-3 of FIG. 2.
Figure 4:
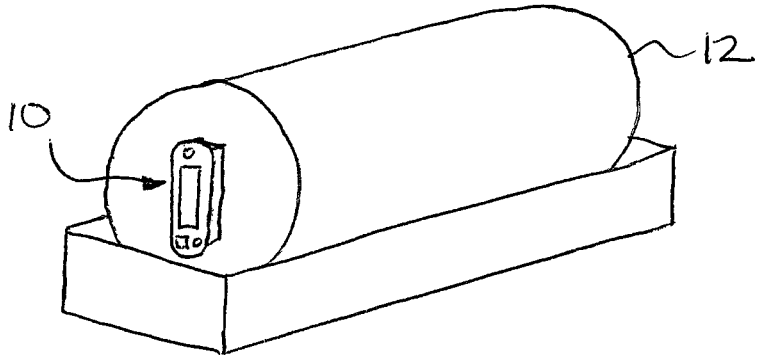
FIG. 4 is a perspective view of the heating assembly shown supported on a horizontal tank.
Figure 5:
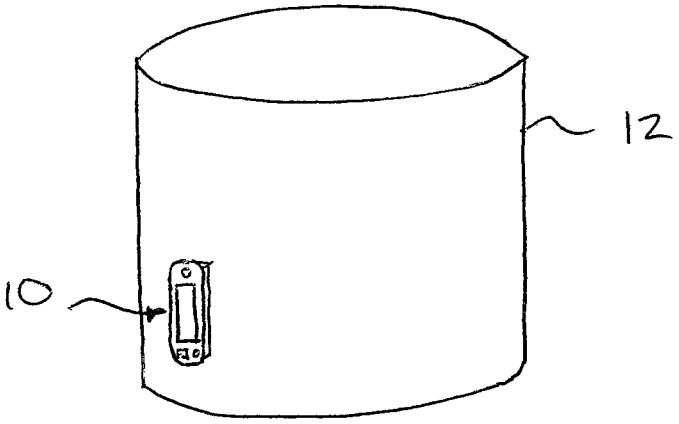
FIG. 5 is a perspective view of the heating assembly shown supported on an upright tank.

Referring to the accompanying figures, there is illustrated a heating assembly generally indicated by reference numeral 10. The assembly 10 is suited for heating a liquid storage tank 12 having tank boundary walls 14 surrounding the hollow interior which defines a main liquid storage portion for storing liquid, for example oil therein. The heating assembly 10 is used with a hydrocarbon fuelled flameless catalytic heater unit 16.

The heater unit 16 in a conventional catalytic heater unit, for example of the type available under the trademark name Catadyne. A typical heater unit relies on a flameless combustion or oxidation of a gaseous hydrocarbon fuel, for example natural gas or propane fed by a fuel supply line, in order to produce heat. The heater unit typically includes a respective housing which contains a catalyst pad having a catalyst carried on a substrate to provide a catalyst bed upon which the fuel is combusted. The combustion is an exothermic oxidation reaction between the hydrocarbon fuel and oxygen, assisted by the presence of the catalyst, to produce water vapor, carbon dioxide and radiant heat in the form of infrared energy. An electrical heating element may be included, within the housing of the heater unit to preheat the catalyst pad initially during start-up of the heater unit.

The heating assembly 10 generally includes a heater casing 20 which is elongate in a longitudinal direction between an external end 22 arranged to be supported in proximity to a boundary wall of the storage tank, and an interior end 24 arranged to be positioned within the interior storage chamber of the storage tank 12 at a location spaced inwardly from the corresponding boundary wall.

More particularly, the casing 20 comprises a top wall 26, a bottom wall 28, and two laterally opposed side walls 30 which collectively surround the heating chamber while spanning in the longitudinal direction between the opposing exterior and interior ends. A first end wall 32 spans the exterior end and a corresponding second end wall 34 spans the interior end to fully enclose the interior chamber.

The first end wall 32 protrudes outwardly beyond the corresponding casing walls 26, 28 and 30 on all sides to define a casing mounting flange 36 as the peripheral portion of the first end wall protruding beyond the casing walls. The casing mounting flange 36 thus extends about the full circumference of the casing while being oriented in a plane which is perpendicular to the longitudinal direction thereof.

The storage tank 12 is prepared to receive the casing of the heating assembly therein by providing the tank with a tank opening 38 in an upright one of the boundary walls. The tank opening is suitably sized to receive the casing inserted into the storage tank therethrough. A mounting collar 40 is mounted about the periphery of the tank opening in which the collar projects perpendicularly outward from the corresponding boundary wall about the tank opening.

At the exterior end of the collar 40, a tank mounting flange 42 is provided which extends radially outward from the outer end of the collar 40 about the full circumference thereof so that the tank mounting flange is generally annular in shape and is oriented parallel to the corresponding boundary wall at a location spaced longitudinally outward in the axial direction of the weld collar from the boundary wall. The tank mounting flange 42 is substantially identical in size and configuration to the casing mounting flange 36 in which both mounting flanges include corresponding fastener holes which are aligned with one another in a mounted position of the casing on the storage tank.

A suitable annular gasket 44 is sandwiched between the mounting flanges with corresponding bolts 46 extending in the axial direction through co-operating apertures in both mounting flanges to clamp the mounting flanges together with the gasket therebetween. The collar 40 provides sufficient space between the tank mounting flange 42 and the boundary wall to provide access to the fasteners from behind.

In a mounted position, the casing 20 is fully received within the interior of the tank so as to be substantially fully received within the perimeter of the storage tank as defined by the boundary walls. The casing walls, and in particular the top wall 26, the bottom wall 28, the two side walls 30 and the second end wall 34 are joined to one another and the casing mounting flange 36 so as to collectively form a barrier which fully spans and encloses the tank opening 38 in the mounted position of the casing. The casing protrudes into the storage tank by a sufficient distance such that a catalytic heater unit 16 supported within the heating chamber of the casing can be positioned at a location spaced inwardly from the corresponding boundary wall of the storage tank.

The casing 20 further includes a main opening 50 within the first end wall 32 for communicating to the exterior from the inner heating chamber of the casing. The main opening is suitably sized to permit the catalytic heater unit to be received therethrough. A door 52 is provided which is coupled by hinges to the exterior side of the first end wall so that the door can be pivotally operated between a closed position fully spanning and enclosing the main opening 50, and an open position in which the main opening 50 is sufficiently unobstructed by the door 52 to permit the heater unit to be received through the main opening.

Combustion air is provided to the catalytic heater unit through a combustion air inlet 54 in the form of an opening in the first end wall in proximity to the bottom of the casing, below the main opening 50. The air inlet is sufficiently sized to allow fresh air for combustion to enter therethrough into the interior chamber. A grate or other suitable structure may be provided to partially restrict access through the opening of the air inlet 54. In further arrangements the air inlet may be provided in the door 52 in proximity to the bottom end thereof.

An exhaust collection hood 56 is mounted within the interior of the heating chamber in proximity to the top wall so as to be located directly above the heater unit in the working position thereof. The hood 56 comprises an enclosed duct which is open at the bottom side thereof so that hot exhaust gases will passively rise from the catalytic heater unit up through the open bottom end of the collection hood thereabove. An exhaust opening 58 is provided in the first end wall in proximity to the top end of the casing so as to be located above the main opening 50. An exhaust pipe 60 communicates from the collection hood 56 through the exhaust opening 58 such that exhaust collected within the hood can be subsequently passively directed through the exhaust pipe and to the exterior through the exhaust opening 58.

A fuel source is mounted externally of the casing and storage tank for supplying fuel, for example propane or natural gas, to the catalytic heater unit through a fuel line 62 connected therebetween. The fuel line 62 communicates through a corresponding fuel opening in the first end wall in proximity to the combustion air inlet, below the main opening 50. The fuel line 62 includes a flexible portion 64 which communicates between the first end wall and the heater unit to permit displacement of the heater unit relative to the casing during initial mounting of the unit in the casing and during subsequent removal and remounting for maintenance and the like while the fuel line remains connected to the heater unit.

The heater unit is supported within the casing on a carriage member 66 supported within the bottom end of the heating chamber of the casing. A slide assembly comprising longitudinally extending rails 68 support the carriage member and the catalytic heater unit thereon such that the carriage and heater unit are longitudinally slidable along the rails 68 between a working position supported fully within the interior of the heating chamber at a location spaced inwardly from the boundary wall of the storage tank to permit the door to be secured in the closed position, and a loading position in which the carriage and heater unit supported thereon can be slidably displaced outward to project partially or fully through the main opening 50 when the doors opened.

In the mounted position, the heater unit is typically operated steadily at a low level to provide sufficient heat to prevent freezing of the contents of the storage tank. The controller of the catalytic heater unit may include a thermostat which cycles operation of the heater unit simply to maintain air within the enclosed heating chamber receiving the heater unit therein within a prescribed temperature range, or more particularly above a lower limit and below an upper limit of the thermostat.

The exterior of the boundary wall of the storage tank 12 and the exterior of the collar 40 of the storage tank are preferably coated with an insulating material, for example spray foam, to assist in maintaining heat within the storage tank. In addition, the door 52 and the first end wall of the heating assembly may be further insulated with a heat insulating material such as spray foam and the like to minimize heat loss through the exterior end of the casing.

The casing walls including the top wall, the bottom wall, the two side walls, and the second end wall remain uninsulated to permit heat to be readily transferred thereacross from the catalytic heater unit to the surrounding fluid in the storage tank. The heater unit primarily transmits heat in the form of infrared radiant energy which radiates from the heater unit to the casing walls of the casing which then in turn transfers heat to the surrounding fluid by conduction and convection.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A heating assembly in combination with a catalytic heater unit and an oil storage tank, the oil storage tank having boundary walls surrounding an interior oil storage chamber, a tank opening in one of the boundary walls, and a tank mounting flange surrounding the tank opening, the catalytic heater unit having a heater housing and a catalyst carried in the heater housing upon which fuel is arranged to be flamelessly combusted to produce radiant heat in the form of infrared energy, and the heating assembly comprising:

a casing including a plurality of casing walls which surround a heating chamber defined within the casing;

a casing mounting flange joined to the casing walls;

the casing mounting flange mounted in sealing engagement relative to the tank mounting flange such that the casing protrudes into the interior oil storage chamber of the oil storage tank;

the casing mounting flange and the casing walls of the casing collectively forming a barrier arranged to fully enclose the tank opening when the casing mounting flange is mounted in sealing engagement relative to the tank mounting flange;

the heating chamber receiving the heater housing of the catalytic heater therein at a location spaced inwardly from the casing mounting flange such that the heater housing of the catalytic heater is fully received within the interior oil storage chamber of the oil storage tank at a location spaced inwardly from the boundary walls of the oil storage tank;

a combustion air inlet formed in the casing arranged to introduce external air into the heating chamber within the casing for combustion by the catalytic heater unit in the heating chamber of the casing; and an exhaust outlet formed in the casing so as to be arranged to collect exhaust emissions from the catalytic heater unit in the heater chamber of the casing and direct the exhaust emissions externally of the casing and the storage tank.

2. The assembly according to claim 1 wherein the casing mounting flange is joined to the casing walls such that the casing is arranged to be fully received within the interior oil storage chamber of the oil storage tank.

3. The assembly according to claim 1 wherein the casing mounting flange is located at one end of the casing.

4. The assembly according to claim 1 further comprising a main opening at one end of the casing which is suitably sized to receive the catalytic heating unit therethrough.

5. The assembly according to claim 4 wherein the casing mounting flange is located at one end of the casing such that the main opening lies in a plane of the casing mounting flange.

6. The assembly according to claim 4 wherein there is provided a door supported on the casing so as to be operable between a closed position spanning the main opening, and an open position in which the main opening is sufficiently unobstructed by the door to receive the catalytic heating unit therethrough.

7. A heating assembly for use with a catalytic heater unit and an oil storage tank having boundary walls surrounding an interior oil storage chamber, a tank opening in one of the boundary walls, and a tank mounting flange surrounding the tank opening, the heating assembly comprising:

a casing including a plurality of casing walls which surround a heating chamber defined within the casing;

a casing mounting flange joined to the casing walls;

the casing mounting flange being mountable in sealing engagement relative to the tank mounting flange such that the casing protrudes into the interior oil storage chamber of the oil storage tank;

the casing mounting flange and the casing walls of the casing collectively forming a barrier arranged to fully enclose the tank opening when the casing mounting flange is mounted in sealing engagement relative to the tank mounting flange;

the heating chamber being suitable sized and configured to operably receive the catalytic heater therein;

a main opening at one end of the casing which is suitably sized to receive the catalytic heating unit therethrough; and a door supported on the casing so as to be operable between a closed position spanning the main opening, and an open position in which the main opening is sufficiently unobstructed by the door to receive the catalytic heating unit therethrough.

8. The assembly according to claim 4 further comprising a carriage member arranged to support the heater unit thereon and a slide assembly supporting the carriage member within the casing so as to be longitudinally slidable between a loading position in proximity to the main opening and a working position spaced inwardly into the heating chamber of the casing from the main opening relative to the loading position.

9. The assembly according to claim 1 wherein the heating chamber of the casing is suitably sized to receive the catalytic heater unit therein such that the casing walls are spaced apart from the catalytic heater unit on all sides thereof.

10. The assembly according to claim 1 wherein the combustion air inlet and the exhaust outlet are formed in a common one of the casing walls at an exterior end of the casing.

11. The assembly according to claim 1 wherein the combustion air inlet is located in proximity to a bottom end of the casing.

12. The assembly according to claim 1 wherein the exhaust outlet is located in proximity to a top end of the casing.

13. The assembly according to claim 12 further comprising an exhaust collection hood supported within the casing and arranged to collect the exhaust emissions from the heater unit received therebelow, the exhaust collection hood being in communication with the exhaust outlet.

14. The assembly according to claim 1 further comprising a fuel supply line arranged to communicate between an external fuel supply and the catalytic heating unit within the heating chamber of the casing, at least a portion of the fuel supply line within the heating chamber of the casing comprising a flexible line.

15. The assembly according to claim 7 wherein the door is heat insulated.

16. A heating assembly for use with a catalytic heater unit and an oil storage tank having boundary walls surrounding an interior oil storage chamber, a tank opening in one of the boundary walls, and a tank mounting flange surrounding the tank opening, the heating assembly comprising:

a casing including a plurality of casing walls which surround a heating chamber defined within the casing;

a casing mounting flange joined to the casing walls;

the casing mounting flange being mountable in sealing engagement relative to the tank mounting flange such that the casing protrudes into the interior oil storage chamber of the oil storage tank;

the casing mounting flange and the casing walls of the casing collectively forming a barrier arranged to fully enclose the tank opening when the casing mounting flange is mounted in sealing engagement relative to the tank mounting flange;

the heating chamber being suitable sized and configured to operably receive the catalytic heater therein;

a combustion air inlet and an exhaust outlet formed in the casing so as to be arranged to communicate from the heating chamber to an exterior of the storage tank;

the exhaust outlet is located in proximity to a top end of the casing; and an exhaust collection hood supported within the casing so as to be arranged to receive exhaust from the heater unit received therebelow, the exhaust collection hood being in communication with the exhaust outlet.

* * * * *